US010074335B2

(12) United States Patent
Ito

(10) Patent No.: US 10,074,335 B2
(45) **Date of Patent: *Sep. 11, 2018**

(54) ELECTROOPTICAL DEVICE AND ELECTRONIC APPARATUS

(71) Applicant: SEIKO EPSON CORPORATION, Tokyo (JP)

(72) Inventor: Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/242,498

(22) Filed: Aug. 20, 2016

(65) Prior Publication Data

US 2016/0358578 A1 Dec. 8, 2016

Related U.S. Application Data

(63) Continuation of application No. 13/219,154, filed on Aug. 26, 2011, now Pat. No. 9,460,680.

(30) Foreign Application Priority Data

Sep. 3, 2010 (JP) ..... 2010-197924

(51) Int. Cl.

| | |
|---|---|
| ***G09G 5/10*** | (2006.01) |
| ***G09G 3/36*** | (2006.01) |
| ***G06G 5/00*** | (2006.01) |
| *G09G 3/20* | (2006.01) |

(52) U.S. Cl.

CPC ..... *G09G 3/3688* (2013.01); *G09G 3/3614* (2013.01); *G09G 3/20* (2013.01); *G09G 2310/0218* (2013.01); *G09G 2310/0248* (2013.01); *G09G 2310/0275* (2013.01); *G09G 2310/0297* (2013.01); *G09G 2310/08* (2013.01);

(Continued)

(58) Field of Classification Search

CPC .... G09G 5/00; G09G 3/36; G09G 2310/0248; G09G 2310/0251

See application file for complete search history.

(56) References Cited

U.S. PATENT DOCUMENTS 4,709,995 A * 12/1987 Kuribayashi ..... H04N 3/127 345/691
5,510,807 A 4/1996 Lee et al.
6,359,608 B1 3/2002 Lebrun et al.

(Continued)

FOREIGN PATENT DOCUMENTS

JP 11-502325 A 2/1999
JP 2004-045967 A 2/2004

(Continued)

*Primary Examiner* — Michael J Jansen, II
*Assistant Examiner* — Paras D Karki
(74) *Attorney, Agent, or Firm* — Maschoff Brennan

(57) ABSTRACT

A scanning line driving circuit sequentially selects each of a plurality of scanning lines for each unit period. A signal supply circuit supplies, to a signal line, a gradation potential in accordance with a designated gradation of a pixel in a write period within the unit period. The signal supply circuit supplies a pre-charge potential to the signal line in a pre-charge period before the start of the write period in a first unit period of the plurality of unit periods, and the supply of the pre-charge potential to the signal line stops in a second unit period.

15 Claims, 11 Drawing Sheets

(52) U.S. Cl.
CPC ..... *G09G 2320/0209* (2013.01); *G09G 2320/0233* (2013.01)

(56) References Cited

U.S. PATENT DOCUMENTS

| | | | | |
|---|---|---|---|---|
| 2003/0080932 | A1* | 5/2003 | Konno | G09G 3/3648 345/96 |
| 2005/0041488 | A1 | 2/2005 | Ito et al. | |
| 2006/0119566 | A1 | 6/2006 | Sato et al. | |
| 2006/0125740 | A1 | 6/2006 | Shirasaki et al. | |
| 2006/0221015 | A1* | 10/2006 | Shirasaki | G09G 3/325 345/77 |
| 2007/0115240 | A1* | 5/2007 | Tanaka | G09G 3/3677 345/98 |
| 2007/0200810 | A1* | 8/2007 | Kawata | G09G 3/3611 345/89 |
| 2008/0024404 | A1 | 1/2008 | Tanaka et al. | |
| 2008/0043012 | A1* | 2/2008 | Shirai | G09G 3/2011 345/215 |
| 2008/0079710 | A1* | 4/2008 | Ishii | G09G 3/2096 345/215 |
| 2008/0117235 | A1 | 5/2008 | Morita | |
| 2008/0180589 | A1 | 7/2008 | Woo et al. | |
| 2009/0122035 | A1 | 5/2009 | Ito | |
| 2012/0169753 | A1 | 7/2012 | Murakami et al. | |

FOREIGN PATENT DOCUMENTS

| | | | |
|---|---|---|---|
| JP | 2005-043418 | A | 2/2005 |
| JP | 2006-308712 | A | 11/2006 |
| JP | 2009-116247 | A | 5/2009 |
| JP | 2009-187035 | A | 8/2009 |

* cited by examiner

ELECTROOPTICAL DEVICE AND ELECTRONIC APPARATUS

CROSS-REFERENCE TO RELATED APPLICATIONS

This application is a continuation of U.S. patent application Ser. No. 13/219,154, filed Aug. 26, 2011, which claims priority to Japanese Patent Application No. 2010-197924 filed on Sep. 3, 2010. The foregoing patent applications are incorporated herein by reference.

BACKGROUND

1. Technical Field

The present invention relates to a technology that displays an image using an electrooptical element such as a liquid crystal element, and the like.

2. Related Art

In the related art, an electrooptical device in which pixels (pixel circuit) are arranged so as to correspond to each intersection of a plurality of scanning lines and a plurality of signal lines in a matrix has been proposed. Each of the plurality of scanning lines is sequentially selected for each horizontal scanning period, so that a display gradation of the pixel is set to be variable in accordance with a potential of the signal line at the time of selection of each of the scanning lines. In JP-A-2005-43418, a technology that suppresses display speckles (vertical crosstalk) of a display image by supplying a predetermined pre-charge potential to the signal lines for each selection of the scanning lines has been disclosed.

Power is consumed due to the occurrence of the charging and discharging of charge that is accumulated in the signal line at the time of the supply of the pre-charge potential with respect to each of the signal lines. Accordingly, in JP-A-2005-43418 that supplies the pre-charge potential to the signal lines for each selection of the scanning lines, there is a problem in that consumption of the power which is caused by the supply of the pre-charge potential is increased.

SUMMARY

An advantage of some aspects of the invention is to reduce consumption of power which is caused by the supply of a pre-charge potential to each signal line.

According to an aspect of the invention, there is provided an electrooptical device, including: a plurality of pixels that is arranged so as to correspond to each intersection of a plurality of scanning lines and a plurality of signal lines, and displays a gradation corresponding to a potential of the signal line at the time of selection of the scanning line; a scanning line driving circuit that sequentially selects the plurality of scanning lines for each of a plurality of unit periods; and a signal supply circuit (for example, a signal supply circuit 24, a signal supply circuit 24A, and a signal supply circuit 24B) that supplies, to each of the plurality of signal lines, a gradation potential corresponding to a designated gradation of each of the plurality of pixels in a write period of the unit period, supplies a pre-charge potential to each of the plurality of signal lines before the start of the write period in a first unit period (for example, a unit period U1) of the plurality of unit periods, and stops the supply of the pre-charge potential corresponding to each of the plurality of signal lines in a second unit period (for example, a unit period U2) which is different from the first unit period. The electrooptical device of the present invention can be mounted in a variety of electronic apparatuses (for example, a mobile phone, or a projection-type display apparatus) as a display apparatus.

In this configuration, the supply of the pre-charge potential to each of the signal lines stops in the second unit period, while the pre-charge potential is supplied to each of the signal lines in the first unit period so that display speckles are reduced. Accordingly, in comparison with a configuration in which the pre-charge potential is supplied to each of the signal lines in all the unit periods, consumption of power which is caused by the supply of the pre-charge potential to each of the signal lines is reduced.

In a first aspect of the present invention, the first unit period and the second unit period may be set to the same time length, and the write period of the first unit period and the write period of the second unit period may be set to the same time length. In the above aspect, when comparing a configuration (a second aspect which will be described later) in which the time length of the write period is set to a time length different from each other in the first unit period and the second unit period, and a configuration (a first aspect which will be described later) in which the first unit period and the second unit period are set to a time length different from each other, there is an advantage in that it is easy to control the scanning line driving circuit and the signal supply circuit. Further, a specific example of the first aspect will be described later as, for example, a first aspect.

In a second aspect of the present invention, the first unit period and the second unit period may be set to the same time length, and a time length (for example, a time length tw2 of FIG. 5) of the write period of the second unit period may be longer than a time length (for example, a time length tw1 of FIG. 5) of the write period of the first unit period. In the above aspect, the write period in which the gradation potential is supplied to each of the pixels in the second unit period is set to a time longer than the first unit period by the omission of the pre-charge period. Accordingly, it is possible to accurately supply the target gradation potential to each of the pixels in the second unit period. Further, a specific example of the second aspect will be described later as, for example, a second aspect.

In a third aspect of the present invention, the write period of the first unit period and the write period of the second unit period may be set to the same time length, and a time length (for example, a time length tu2 of FIG. 6) of the second unit period may be shorter than a time length (for example, a time length tu1 of FIG. 6) of the first unit period. In the above aspect, the second unit period is set to the time length shorter than the first unit period by the omission of the pre-charge period. Accordingly, as compared to a configuration in which the first unit period and the second unit period are set to the same time length, a ratio of the write period which occupies the sum of the first unit period and the second unit period is relatively increased. Accordingly, it is possible to supply the target gradation potential to each of the pixels reliably. In addition, since the write period is set to the same time length in the first unit period and the second unit period, as compared to the second aspect in which the time length of the write period is different from each other in the first unit period and the second unit period, there is an advantage in that a display gradation becomes uniform in each of the pixels to which the gradation potential is supplied in the first unit period, and each of the pixels to which the gradation potential is supplied in the second unit period. Further, a specific example of the third aspect will be described later as a third aspect.

In a preferred aspect of the present invention, the scanning line driving circuit may sequentially select each of the plurality of scanning lines for each of the unit periods in each of a plurality of vertical scanning periods, and each of the plurality of vertical scanning periods may include a first unit period and a second unit period. In the above configuration, since the first unit period and the second unit period coexist in each of the vertical scanning periods, there is an advantage in that a difference of the display gradation which is caused by the presence or absence of the supply of the pre-charge potential is hardly perceived by a user in each of the pixels to which the gradation potential is supplied in the first unit period, and each of the pixels to which the gradation potential is supplied in the second unit period. According to a configuration in which each of the plurality of unit periods corresponding to the odd number lines is set to one of the first unit period and the second unit period, and each of the plurality of unit periods corresponding to the even number lines is set to the other of the first unit period and the second unit period, the above described effects become significantly apparent.

Further, a period of the switching (switching of presence or absence of the supply of the pre-charge potential) of the first unit period and the second unit period may be arbitrarily set. For example, as described above, other than the configuration in which the first unit period and the second unit period coexist in the vertical scanning period, even a configuration in which the first unit period and the second unit period are switched for each of the vertical scanning periods in a case in which each of the unit periods is set to the first unit period in a single vertical scanning period, and at the same time, each of the unit periods is set to the second unit period in other vertical scanning periods may be also adopted. That is, the present invention includes both a configuration in which the first unit period and the second unit period coexist in a single vertical scanning period, and a configuration in which the first unit period and the second unit period respectively exist in a separate vertical scanning period.

In a preferred aspect of the present invention, each of the plurality of unit periods may be set to one of the first unit period and the second unit period in each of the first vertical scanning periods, and may be set to the other of the first unit period and the second unit period in each of the second vertical scanning periods which is different from the first vertical scanning period. In the above aspect, each of the unit periods is temporally changed from one of the first unit period that includes the pre-charge period and the second unit period that does not include the pre-charge period to the other. Accordingly, a difference of a display gradation of each of the pixels in accordance with presence and absence of the supply of the pre-charge potential is temporally equalized, so that display speckles are effectively reduced.

In a preferred aspect of the present invention, the signal supply circuit may include a signal generation circuit (a signal generation circuit 52 of FIG. 4) that supplies, to a control line (for example, a control line 16 of FIG. 4), a control signal which is set to a pre-charge potential in a pre-charge period before the start of the write period of each of the plurality of first unit periods while being set to the gradation potential corresponding to the designated gradation of each of the plurality of pixels in a time division manner in the write period of each of the unit periods, a plurality of switches (for example, switches 58[1] to 58[*k*] of FIG. 4) that controls the connection between each of the plurality of signal lines and the control line, and a control circuit that controls all of the plurality of switches in an on state in the pre-charge period of the plurality of first unit periods, and sequentially controls each of the plurality of switches in an on state in the write period of each of the plurality of unit periods. In the above embodiment, since the path for supplying the gradation potential and the pre-charge potential to each of the signal lines is made common, there is an advantage in that a configuration of the electrooptical device is simplified as compared to a configuration in which the supply path of both of the potentials is separately installed. However, a configuration (for example, a signal supply circuit 24B of FIG. 9) in which the gradation potential and the pre-charge potential are respectively supplied to each of the signal lines in a separate path is also included in the scope of the present invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
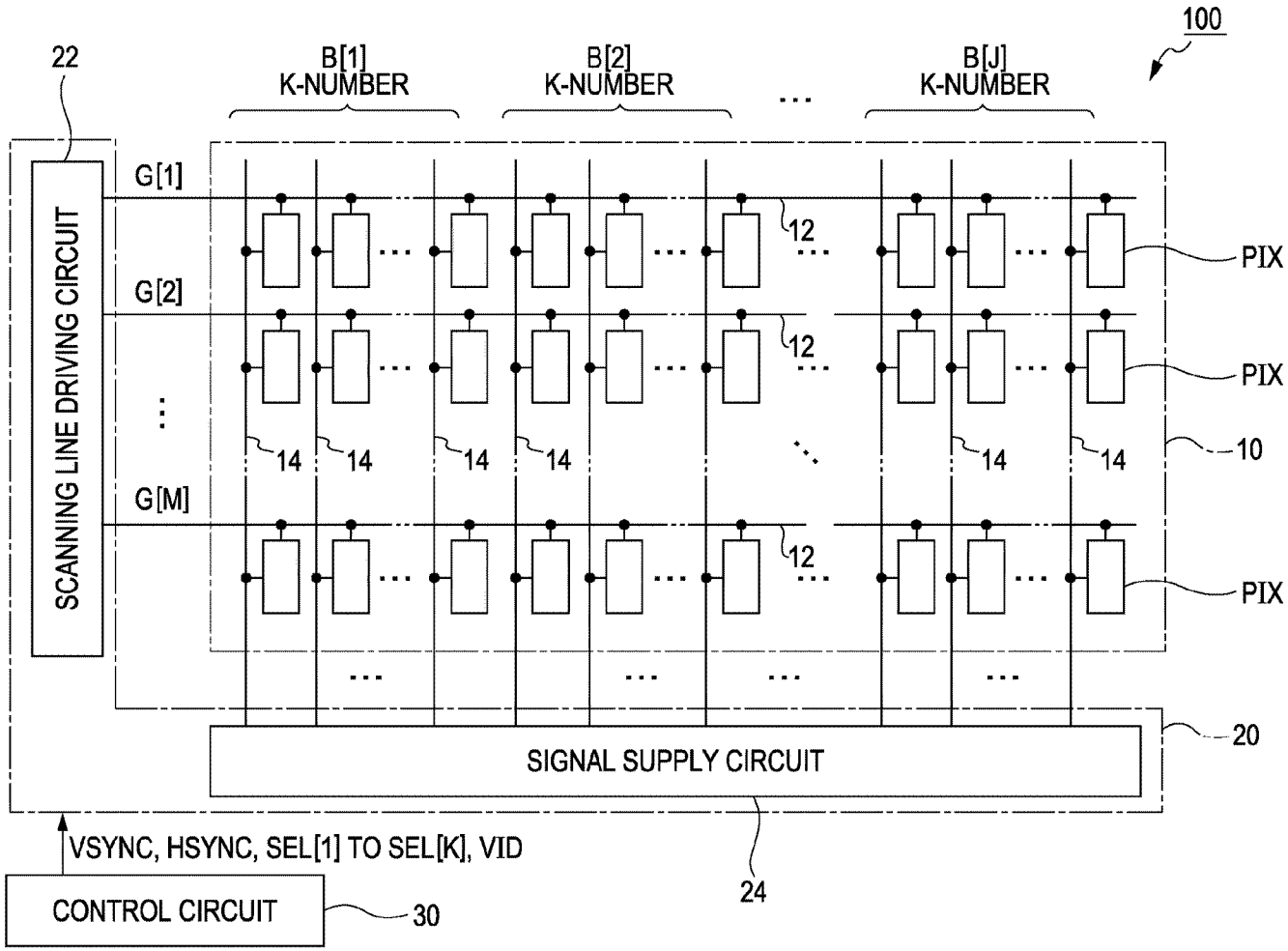
FIG. 1 is a block diagram of an electrooptical device according to a first embodiment of the present invention.

FIG. 1 is a block diagram of an electrooptical device 100 according to a first embodiment of the present invention. The electrooptical device 100 is a liquid crystal device that is mounted in a variety of electronic apparatuses as a display apparatus for displaying an image. As shown in FIG. 1, the electrooptical device 100 includes a pixel unit 10 in which a plurality of pixels PIX (pixel circuit) is arranged in a plane shape, a driving circuit 20 for driving each of the pixels PIX, and a control unit 30 for controlling the driving circuit 20. The driving circuit 20 includes a scanning line driving circuit 22 and a signal supply circuit 24 (signal line driving circuit).

In the pixel unit 10, M scanning lines 12 and N signal lines 14 crossing each other are formed (M and N being a natural number). The plurality of pixels PIX is disposed to correspond to intersections of each of the scanning lines 12 and each of the signal lines 14, and arranged in a matrix of a vertical M-th line and a horizontal n-th row. As shown in FIG. 1, N signal lines 14 within the pixel unit 10 are divided into J wiring groups (block) B[1] to B[J] using K-number (k being a natural number≥2) of the adjacent signal lines as a unit (J=N/K).

Figure 2:
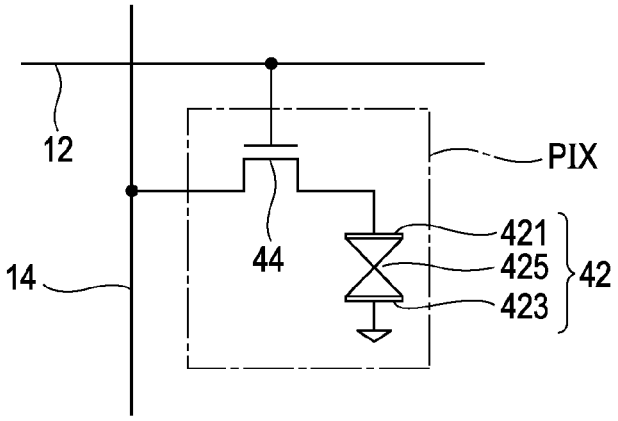
FIG. 2 is a circuit diagram of a pixel.

FIG. 2 is a circuit diagram of each of pixels PIX. As shown in FIG. 2, each of the pixels PIX includes a liquid crystal element 42 and a selection switch 44. The liquid crystal element 42 is an electrooptical element that includes a pixel electrode 421 and a common electrode 423 facing each other, and a liquid crystal 425 between the two electrodes. Transmittance of the liquid crystal 425 is changed in accordance with voltage applied between the pixel electrode 421 and the common electrode 423.

The selection switch 44 includes an N-channel type thin film transistor having a gate connected to the scanning line 12, and controls electrical connection (conduction/non-conduction) between the liquid crystal element 42 (the pixel electrode 421) and the signal line 14 interposing therebetween. Accordingly, the pixel PIX (the liquid crystal element 42) displays a gradation in accordance with a potential (a gradation potential VG which will be described later) of the signal line 14 when the selection switch 44 is controlled to be in an on state. Further, an auxiliary capacitor, and the like connected in parallel to the liquid crystal element 42 is not shown. In addition, a configuration of the pixel PIX may be appropriately changed.

Figure 3:
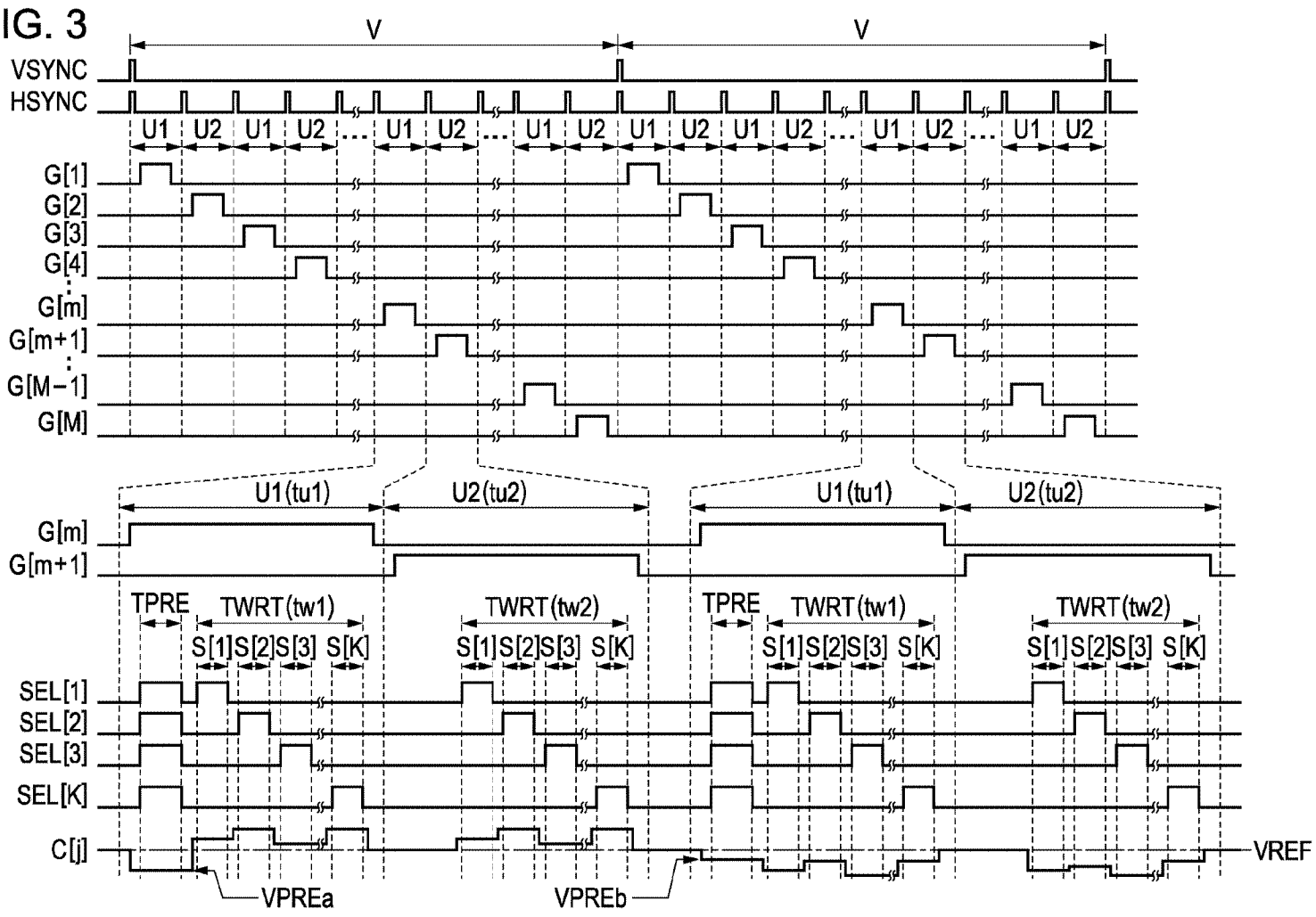
FIG. 3 is a diagram for explaining an operation of an electrooptical device.

The control circuit 30 of FIG. 1 controls the driving circuit 20 using outputs of a variety of signals including synchronization signals. For example, as shown in FIG. 3, the control circuit 30 supplies a synchronization signal VSYNC defining a vertical scanning period V and a synchronization signal HSYNC defining a horizontal scanning period H to the scanning line driving circuit 22 and the signal supply circuit 24. In addition, the control circuit 30 supplies, to the signal supply circuit 24, a pixel signal VID defining a gradation of each of the pixels PIX in a time division manner, and selection signals SEL[1] to SEL[K] of K systems corresponding to the number of the signal lines 14 within each of the wiring groups B[j] (j=1 to J).

The scanning line driving circuit 22 of FIG. 1 sequentially selects each of M scanning lines 12 for each unit period U (U1 and U2) by supplying the scanning signals G[1] to G[M] to each of the scanning lines 12. The unit period U is set to a time length (horizontal scanning period) of a signal period of the synchronization signal HSYNC. As shown in FIG. 3, the scanning signal G[m] supplied to the scanning line in an m-th line is set to a high level (a potential signifying the selection of the scanning line 12) in an m-th unit period U of M unit periods U within each of the vertical scanning periods V. When the scanning line driving circuit 22 selects the scanning line 12 in the m-th line, each selection switch 44 of N pixels PIX in an m-th line shifts to an on state. The signal supply circuit 24 of FIG. 1 is synchronized with the selection of the scanning line 12 by the scanning line driving circuit 22, and controls each potential of N the signal lines 14.

As shown in FIG. 3, the M unit periods U within each of the vertical scanning periods V are divided into a unit period U1 and a unit period U2. The unit period U1 is the unit period U that is selected by the scanning line 12 in odd-number lines, and the unit period U2 is the unit period U that is selected by the scanning line 12 in even-number lines. That is, the unit period U1 and the unit period U2 are arranged alternatingly within the vertical scanning periods V. A time length tu1 of the unit period U1 and a time length tu2 of the unit period U2 are the same.

As shown in FIG. 3, each of the unit periods U1 of the M unit periods U includes a pre-charge period TPRE and a write period TWRT. The pre-charge period TPRE is set before the start of the write period TWRT. On the other hand, each unit period U2 of the M unit periods U includes the write period TWRT. The pre-charge period TPRE is not set within the unit period U2. A time length tw1 of the write period TWRT within the unit period U1 and a time length tw2 of the write period TWRT within the unit period U2 are the same. In the write period TWRT within each of the unit periods U (U1 and U2), a gradation potential VG in accordance with a designated gradation of each pixel PIX is supplied to each signal line 14, and in the pre-charge period TPRE within the unit period U1, a predetermined pre-charge potential VPRE (VPREa and VPREb) is supplied to each signal line 14. On the other hand, in the unit period U2, the supply of the pre-charge potential VPRE to each signal line 14 stops.

Figure 4:
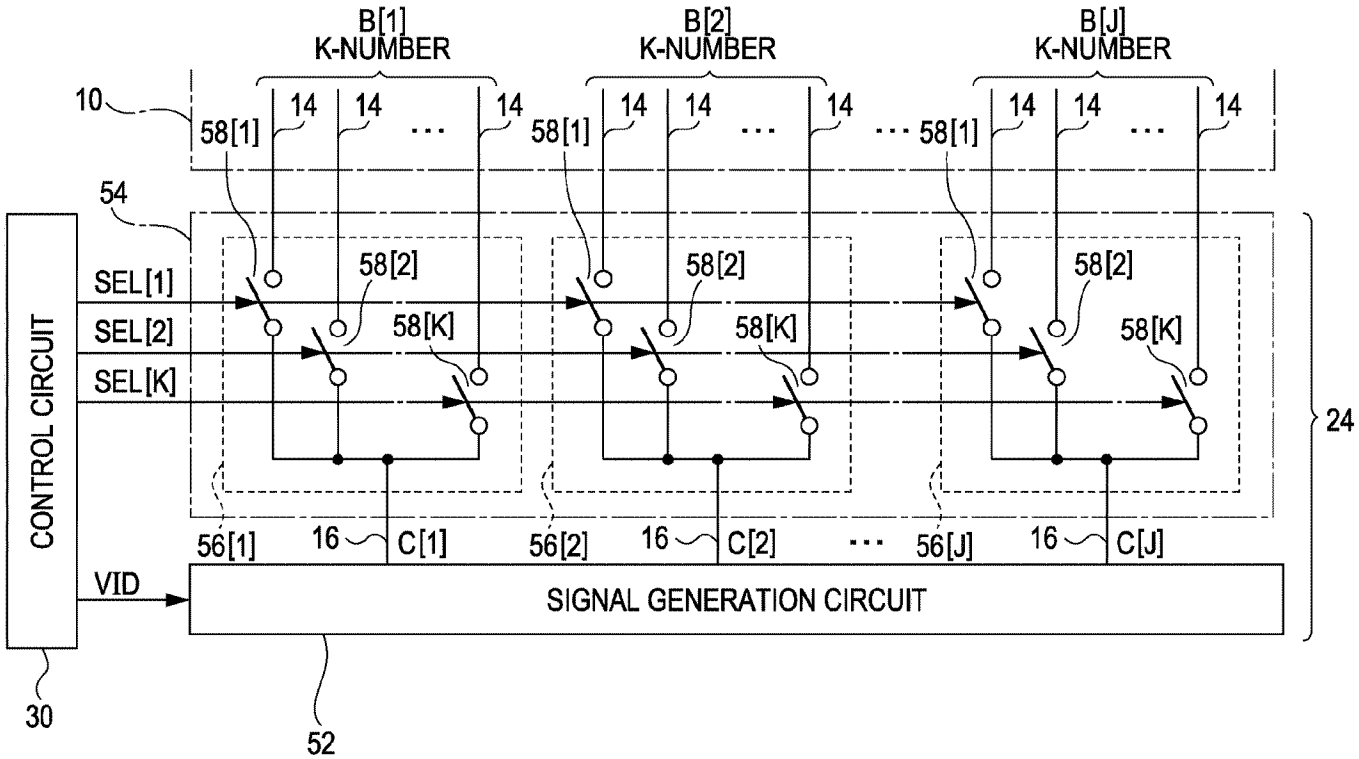
FIG. 4 is a block diagram of a signal line driving circuit.

FIG. 4 is a block diagram of a signal supply circuit 24. As shown in FIG. 4, the signal supply circuit 24 includes a signal generation circuit 52 and a signal distribution circuit 54. The signal generation circuit 52 and the signal distribution circuit 54 are connected to each other through J control lines 16 corresponding to different wiring groups B[j]. The signal generation circuit 52 is mounted in a form of an integrated circuit (chip), and the scanning line driving circuit 22 and the signal distribution circuit 54 includes a thin film transistor that is formed on a surface of a substrate together with the pixel PIX. However, a type in which the driving circuit 20 is mounted is arbitrarily changed.

The signal generation circuit 52 of FIG. 4 supplies in parallel, to each control line 16, control signals C[1] to C[J] of J systems corresponding to different wiring groups B[j]. As shown in FIG. 3, the signal generation circuit 52 sets the control signals C[1] to C[J] to the pre-charge potential VPRE (VPREa and VPREb) in the pre-charge period TPRE within each of the unit periods U1. The pre-charge potential VPRE is set to a potential with the negative polarity with respect to a predetermined reference potential VREF (for example, a potential corresponding to an amplitude center of the gradation potential VG). In each of the unit periods U2 that does not include the pre-charge period TPRE, the control signals C[1] to C[J] are set to the pre-charge potential VPRE.

In addition, in the write period TWRT within the unit periods U (U1 and U2) in which the scanning line 12 in an m-th line is selected, the signal generation circuit 52 sets, in a time division manner, the control signal C[j] to the gradation potential VG in accordance with designated gradations of K pixels PIX corresponding to each intersection between the scanning line 12 in the m-th line and K signal lines 14 of the wiring group B[j]. The designated gradation of each of the pixels PIX is defined through an image pixel signal VID supplied from the control circuit 30. The polarity of the gradation potential VG with respect to the reference potential VREF is periodically and sequentially reversed (for example, for each vertical scanning period V). As shown in FIG. 3, each of the control signals C[1] to C[J] is set to the pre-charge potential VPREa in the pre-charge period TPRE immediately before the write period TWRT in which the gradation potential VG is set to the positive polarity with respect to the reference potential VREF, and is set to the pre-charge potential VPREb in the pre-charge period TPRE immediately before the write period TWRT in which the gradation potential VG is set to the negative polarity. The pre-charge potential VPREa is set to a potential (a potential in which a difference with the reference potential VREF is great) lower than the pre-charge potential VPREb.

As shown in FIG. 4, the signal distribution circuit 54 includes J distribution circuits 56 [1] to 56[J] corresponding to different wiring groups B[j]. A j-th distribution circuit 56[*j*] is a circuit (a demultiplexer) for distributing the control signal C[j] supplied to a j-th control line 16 to each of K signal lines 14 of the wiring group B[j], and includes K switches 58[1] to 58[K] corresponding to different signal lines 14 of the wiring group B[j]. A k-th (k=1 to k) switch 58[*k*] of the distribution circuit 56[*j*] controls electrical connection (conduction/non-conduction) between the signal line 14 in a k-th row of the K signal lines 14 of the wiring group B[j] and the j-th control line 16 of J control lines 16 interposing therebetween. Each of selection signals SEL[k] generated by the control circuit 30 is supplied in parallel to a gate of a k-th switch 58[*k*] (a total of J switches 58[*k*] within the signal distribution circuit 54) in each of J distribution circuits 56[1] to 56[J].

As shown in FIG. 3, the control circuit 30 sets, to an active level (a potential for shifting the switch 58[*k*] to be in an on state), all of selection signals SEL[1] to SEL[K] of K systems in the pre-charge period TPRE within each of the unit periods U1. Accordingly, in the pre-charge period TPRE within each of the unit periods U1, all of the switches 58[*k*] ((J×K)-number) within the signal distribution circuit 54 is shifted to be in the on state, and the pre-charge potential VPRE is supplied in parallel to each of N signal lines 14 (furthermore, the pixel electrode 421 within each of the pixels PIX). As described above, since the potential of each of the signal lines 14 is initialized to the pre-charge potential VPRE before the supply of the gradation potential VG to each of the pixels PIX (before the write), it is possible to suppress display speckles (vertical crosstalk) of a display image.

On the other hand, in the write period TWRT within each of the unit periods (U1 and U2), the control circuit 30 sequentially sets the selection signals SEL[1] to SEL[K] of K systems to an active level in K selection periods S[1] to S[K]. Accordingly, in the selection period S[k] within the unit period U selected by the scanning line 12 in the m-th line, a k-th switch 58[*k*] (a total of J switches 58[*k*] within the signal distribution circuit 54) of K switches 58[1] to 58[K] in each of distribution circuits 56[1] to 56[J] shifts to be in an on state, and the gradation potential VG of the control signal C[j] is supplied to the signal line 14 in a k-th row of each of the wiring groups B[j]. That is, in the write period TWRT within each of the unit periods U (U1 and U2), the gradation potential VG is supplied to K signal lines 14 within the wiring group B[j] in each of J wiring groups B[1] to B[J] in a time division manner. In the selection period S[k] within an m-th unit period U, the gradation potential VG is set in accordance with a designated gradation of the pixel PIX corresponding to the intersection between the scanning line 12 in an m-th line and the signal line 14 in a k-th row of the wiring group B[j].

In the first embodiment described above, the pre-charge potential VPRE is supplied to each of the signal lines 14 in each of the unit periods U1, and the supply of the pre-charge potential VPRE with respect to each of the signal lines 14 in each of the unit periods U2 is omitted. Accordingly, as compared to a configuration in which the pre-charge potential VPRE is supplied to each of the signal lines 14 in all of the unit periods U within the vertical scanning periods V (a configuration of JP-A-2005-43418), there is an advantage in that power consumption caused by the supply of the pre-charge potential VPRE with respect to each of the signal lines 14 is reduced.

Further, in the above embodiment in which the pre-charge potential VPRE is not supplied to the signal line 14 in each of the unit periods U2, there is a possibility that a display gradation of each pixel PIX corresponding to the scanning line 12 selected in the unit period U1 and a display gradation of each pixel PIX corresponding to the scanning line 12 selected in the unit period U2 are strictly different from each other even in a case in which the same gradation is designated in each pixel PIX. However, since the unit period U1 and the unit period U2 coexist in each of the vertical scanning periods V, a difference in the display gradation caused by the stop of the pre-charge potential VPRE in the unit period U2 is hardly perceived by an observer actually. Since the unit period U1 and the unit period U2 are arranged alternatingly in the first embodiment, an effect in which the difference of the display gradation caused by the stop of the pre-charge potential VPRE in the unit period U2 is hardly perceived by the observer is significantly apparent.

B: Second Embodiment

A second embodiment of the present invention will be described. Further, with respect to elements in which effects and functions in each embodiment exemplified below are the same as those of the first embodiment, reference numerals referred to in the above descriptions are diverted, and each of detailed descriptions will be appropriately omitted.

Figure 5:
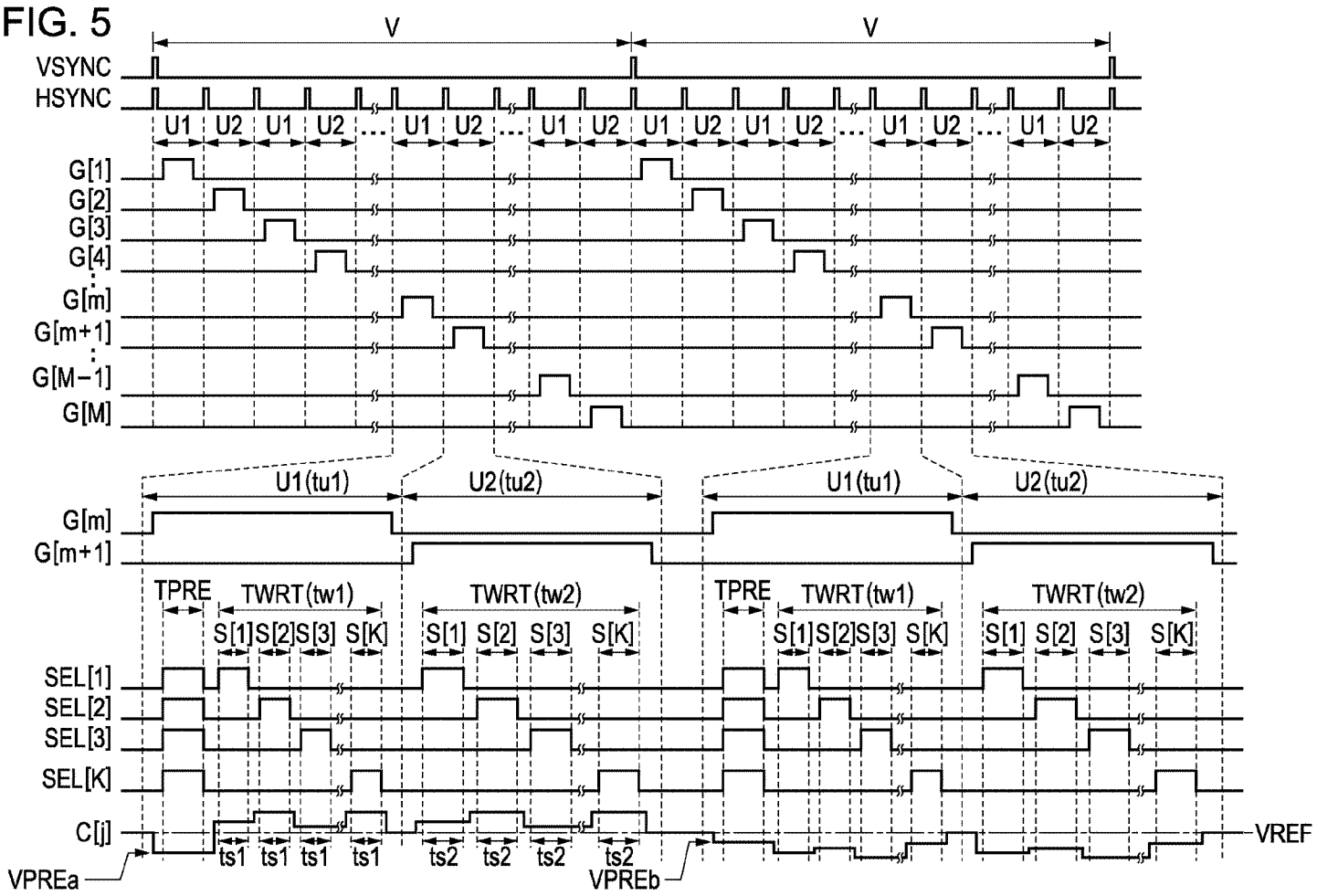
FIG. 5 is a diagram for explaining an operation of an electrooptical device according to a second embodiment.

FIG. 5 is a diagram for explaining an operation of an electrooptical device 100 according to a second embodiment. The unit period U1 which includes the pre-charge period TPRE and the unit period U2 which does not include the pre-charge period TPRE are arranged alternatingly in the vertical scanning periods V. A time length tu1 of the unit period U1 and a time length tu2 of the unit period U2 are the same.

On the other hand, in the second embodiment, the time length tw2 of the write period TWRT of the unit period U2 is set to a time length longer than the time length tw1 of the write period TWRT of the unit period U1 by the omission of the pre-charge period TPRE. Specifically, the time length ts2 (a pulse width of the selection signal SEL[k]) of each selection period S[k] in the write period TWRT of each of the unit periods U2 is set to a time longer than the time length ts1 of each selection period S[k] in the write period TWRT of each of the unit periods U1. That is, the gradation potential VG is supplied to each signal line 14 over the time length ts1 in the write period TWRT within the unit period U1, and the gradation potential VG is supplied to each signal line 14 over the time length ts2 in the write period TWRT within the unit period U2.

Even in the second embodiment described above, since the pre-charge period TPRE within the unit period U2 is omitted, the same effects as those in the first embodiment are realized. In addition, the time length ts2 of the selection period S[k] for supplying the gradation potential VG to each pixel PIX in the unit period U2 is set to a time longer than the time length ts1 of each selection period S[k] within the unit period U1. Accordingly, as compared to a configuration in which the time length of each selection period S[k] is the same in the unit period U1 and the unit period U2, it is possible to accurately supply the target gradation potential VG to each pixel PIX within the unit period U2.

Further, in the above described embodiment, since the time lengths (ts1 and ts2) of the selection period S[k] are different from each other in the unit period U1 and the unit period U2, there is a possibility that the gradation potential VG supplied to each pixel PIX corresponding to the scanning line 12 selected in the unit period U1 and the gradation potential VG supplied to each pixel PIX corresponding to the scanning line 12 selected in the unit period U2 are strictly different from each other even in a case in which the same gradation is designated in each pixel PIX. However, since the unit period U1 and the unit period U2 coexist within each of the vertical scanning periods V, a difference of the gradation potential VG corresponding to the time length of the selection period S[k] is hardly perceived by an observer actually. In the second embodiment, since the unit period U1 and the unit period U2 are arranged alternatingly, an effect in which the difference of the gradation potential VG caused by the time length of the selection period S[k] is hardly perceived by the observer is significantly apparent.

C: Third Embodiment

Figure 6:
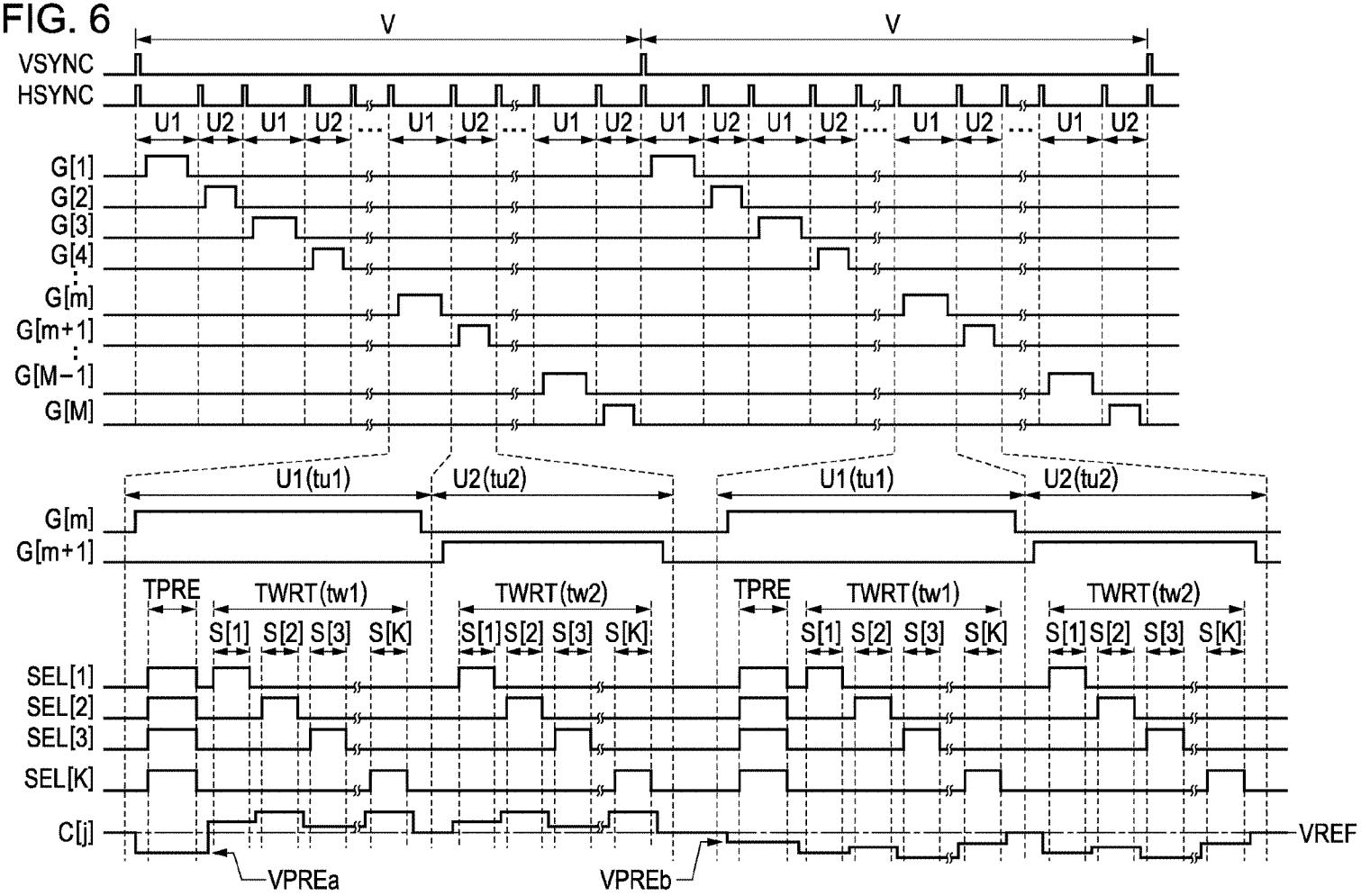
FIG. 6 is a diagram for explaining an operation of an electrooptical device according to a third embodiment.

FIG. 6 is a diagram for explaining an operation of an electrooptical device 100 according to a third embodiment. In the same manner as that of the first embodiment, the unit period U1 which includes the pre-charge period TPRE and the unit period U2 which does not include the pre-charge period TPRE are arranged alternatingly in the vertical scanning period V. A time length of the write period TWRT (each selection period S[k]) is the same in each of the unit periods U1 and each of the unit periods U2. In the third embodiment, a time length tu2 of the unit period U2 is set to a time shorter than the time length tu1 of the unit period U1 by the omission of the pre-charge period TPRE. A total of the time length of the unit period U1 and the unit period U2 which are successive corresponds to a time length equivalent to two horizontal periods that are defined in a horizontal synchronization signal of a video signal supplied to the control circuit 30.

Even in the third embodiment described above, since the pre-charge period TPRE within the unit period U2 is omitted, the same effect as that in the first embodiment is realized. Further, in the first embodiment, since the unit period U2 is set to the same time length as that of the unit period U1 regardless of the omission of the pre-charge period TPRE in the unit period U2, a period during which both the pre-charge potential VPRE and the gradation potential VG are not supplied to each signal line 14 as shown in FIG. 3 is inevitably generated in the unit period U2 (immediately before the write period TWRT). On the other hand, in the third embodiment, since each of the unit periods U2 is set to the time length tu2 shorter than the unit period U1 by the omission of the pre-charge period TPRE (a period during which both the pre-charge potential VPRE and the gradation potential VG are not supplied is omitted), a ratio of the write period TWRT occupying the period including the unit period U1 and the unit period U2 which are successive is increased as compared to the first embodiment. Accordingly, it is possible to accurately set the potential of each signal line 14 to the target gradation potential VG in each selection period S[k].

However, in the first embodiment, the unit period U1 and the unit period U2 are set to the same time length, and at the same time, each write period TWRT is set to the same time length in the unit period U1 and the unit period U2. Accordingly, as compared to the second embodiment in which the time length of the write period TWRT is different from each other in the unit period U1 and the unit period U2, and the third embodiment in which the time length tu1 of the unit period U1 and the time length tu2 of the unit period U2 are different from each other, there is an advantage in that it is easy to control the driving circuit 20.

D: Fourth Embodiment

Figure 7:
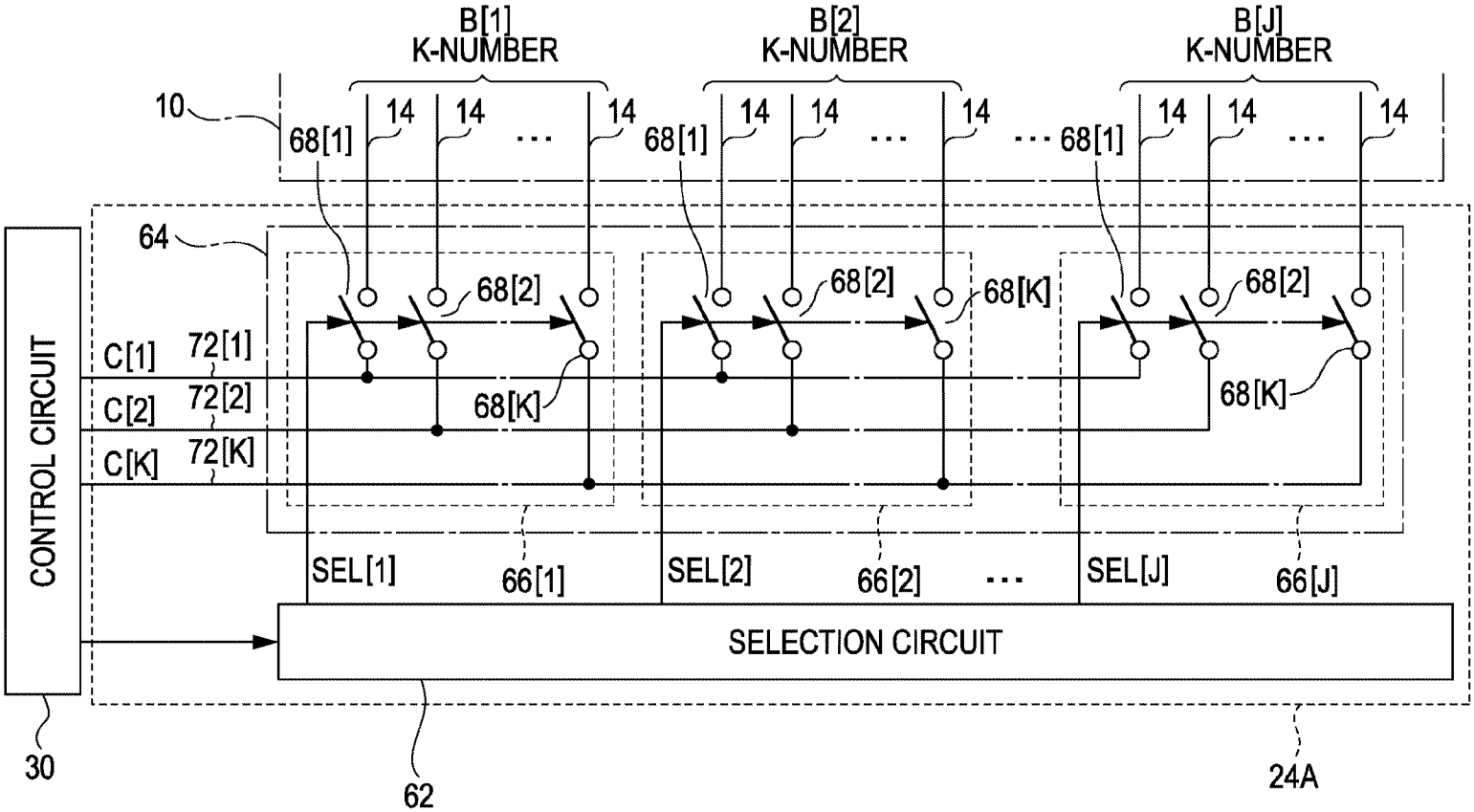
FIG. 7 is a block diagram of a signal supply circuit according to a fourth embodiment.

The electrooptical device 100 of a fourth embodiment has a configuration in which the signal supply circuit 24 of each embodiment described above is substituted by the signal supply circuit 24A of FIG. 7. As shown in FIG. 7, the signal supply circuit 24A includes a selection circuit 62, an output circuit 64, and K control lines 72[1] to 72[K] corresponding to a total number of the signal lines 14 within the wiring group B[j]. The control circuit 30 generates in parallel control signals C[1] to C[K] of K systems. The control signal C[k] is supplied to the control line 72[*k*]. The selection circuit 62 outputs in parallel selection signals SEL[1] to SEL[J] of J systems based on the control performed by the control circuit 30.

The output circuit 64 includes J unit circuits 66[1] to 66[J] corresponding to a total number of the wiring group B[j]. Each unit circuit 66[*j*] includes K switches 68[1] to 68[K]. A k-th switch 68[*k*] within each unit circuit 66[*j*] controls electrical connection (conduction/non-conduction) between the signal line 14 in a k-th row of the wiring group B[j] and a k-th control line 72[*k*] interposing therebetween. When the selection signal SEL[j] output from the selection circuit 62 is set to an active level, K switches 68[1] to 68[K] within the unit circuit 66[*j*] simultaneously shifts to be in an on state.

In the same manner as that in the first embodiment, in each of the vertical scanning periods V, the unit period UI that includes both the pre-charge period TPRE and the write period TWRT, and the unit period U2 that includes the write period TWRT and does not include the pre-charge period TPRE are set alternatingly.

Figure 8:
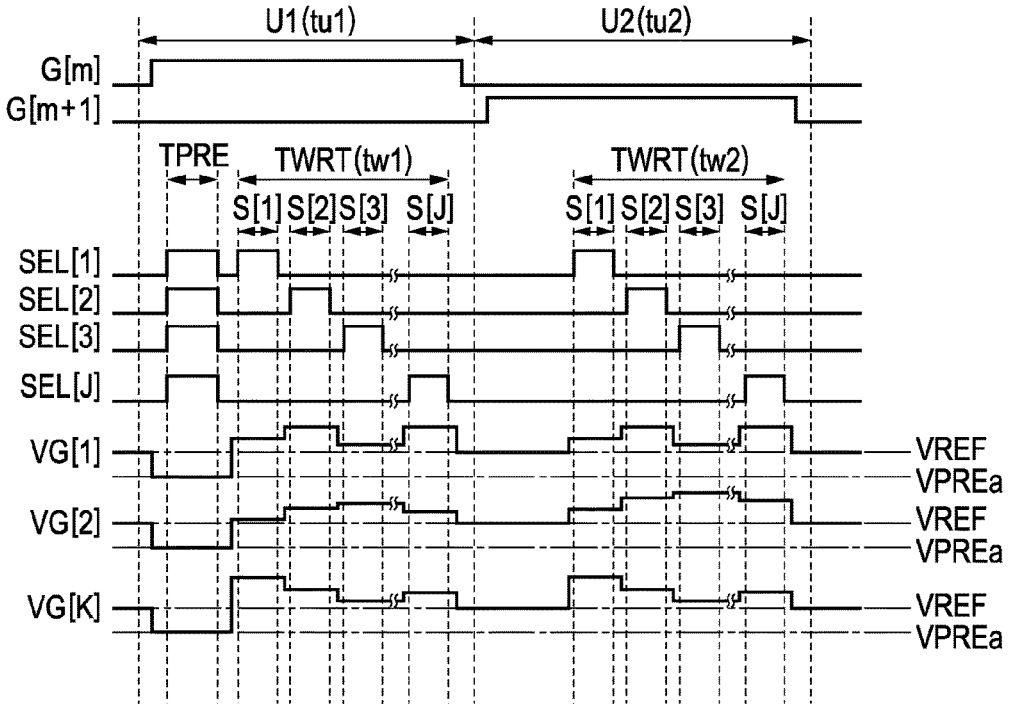
FIG. 8 is a diagram for explaining an operation of an electrooptical device according to a fourth embodiment.

As shown in FIG. 8, in the pre-charge period TPRE of the unit period U1, the control circuit 30 sets all of the control signals C[1] to C[K] of J systems to the pre-charge potential VPRE (VPREa and VPREb), and at the same time, the selection circuit 62 controls all of the selection signals SEL[1] to SEL[K] of K systems to an active level. Accordingly, in the pre-charge period TPRE of each of the unit periods U1, all of the switches 68[*k*] ((K×J)-number) shift to be in an on state, and the pre-charge potential VPRE is supplied to each of N signal lines 14 (furthermore, a pixel electrode 421 within each pixel PIX).

On the other hand, in the write period TWRT within each of the unit periods U (U1 and U2), as shown in FIG. 8, the selection circuit 62 sequentially sets each of the selection signals SEL[1] to SEL[J] of J systems to an active level. In a selection period S[j] in which the selection signal SEL[j] of the write period TWRT becomes the active level, all of K switches 68 within the unit circuit 66[*j*] are controlled to be in the on state. In the selection period S[j] within the unit period U in which the scanning line 12 in an m-th line is selected, the control circuit 30 is set to the gradation potential VG in accordance with a designated gradation of the pixel PIX corresponding to intersection between the scanning line 13 in the m-th line and the signal line 14 in a k-th row of the wiring group B[j] (a phase expansion driving). Accordingly, in the write period TWRT of each of the unit periods U, the gradation potential VG in accordance with a designated gradation is sequentially supplied to N pixels PIX corresponding to each scanning line 12 using K-number corresponding to each of the wiring groups B[j] as a unit.

Even in the fourth embodiment, the same effects as those in the first embodiment are realized. Further, the fourth embodiment has been described based on the first embodiment in the above descriptions; however, a configuration (FIG. 5) of the second embodiment in which the write period TWRT (each selection period S[k]) within the unit period U2 is set to a time length longer than the write period TWRT within the unit period U1, and a configuration (FIG. 6) of the third embodiment in which the unit period U2 is set to the time length tu2 shorter than the unit period U1 are similarly applied even to a configuration of adopting the signal supply circuit 24A shown in FIG. 7.

E: Modified Example

Each embodiment described above may be diversely modified. An embodiment of a specific modification will be exemplified below. Two embodiments or more arbitrarily selected from the examples below may be appropriately merged as long as they do not conflict.

(1) Modified Example 1

In each embodiment described above, a configuration (that is, a configuration in which the pre-charge potential VPRE reaches the pixel electrode 421 via a selection switch 44 being in an on state by the selection of the scanning line 12) in which a period for selecting the scanning line 12 in the unit period U1 includes the pre-charge period TPRE has been exemplified; however, a configuration (that is, a configuration in which the pre-charge potential VPRE does not reach the pixel electrode 421 without selecting the scanning line 12 in the pre-charge period TPRE may be adopted. Since the signal line 14 is initialized to the pre-charge potential VPRE even in any configuration, display speckles of a display image may be suppressed.

(2) Modified Example 2

In the above embodiment, the unit period U1 and the unit period U2 are set alternatingly; however, a period of switching (switching of the presence and absence of the pre-charge) of the unit period U1 and the unit period U2 is appropriately changed. For example, a configuration in which the unit period U1 and the unit period U2 are switched using consecutive plural number of unit periods U within the vertical scanning period V as a unit may be adopted. For example, first to third unit periods U within the vertical scanning period V are set to the unit period U1, and fourth to sixth unit periods U are set to the unit period U2. In addition, a ratio of the number of the unit period U1 and the number of the unit period U2 is arbitrarily set. For example, a configuration (for example, a configuration in which the pre-charge is performed once per three unit periods U, or a configuration in which the pre-charge is performed once per four unit periods U) in which one unit period of a plurality of unit periods U (3) is set to the unit period U1, and at the same time, the remaining unit periods are set to the unit period 2 may be adopted. In addition, a configuration in which the unit period U1 and the unit period U2 are switched using the vertical scanning period V as a period may be also adopted. For example, M unit periods U within the vertical scanning period V are set to the unit period U1, and M unit periods U within the vertical scanning period V immediately after the setting are set to the unit period U2.

(3) Modified Example 3

A configuration in which a relationship between a position of each scanning line 12 selected by the scanning line driving circuit 22 and the unit periods U1 and U2 is changed over time is adopted. For example, in the same manner as that in each embodiment in the vertical scanning period V, the unit period U in which the scanning line 12 in odd-number lines is selected is set to the unit period U1, and at the same time, the unit period U in which the scanning line 12 in even-number lines is selected is set to the period U2. In other vertical scanning periods V, the unit period U in which the scanning line in odd-number lines is selected is set to the unit period U2, and at the same time, the unit period U in which the scanning line 12 in even-number lines is selected is set to the unit period U1. According to the above configuration, since a difference of the display gradation in accordance with presence and absence of the supply of the pre-charge potential VPRE is temporally equalized, an effect concerning the reduction in the display speckles is significantly apparent.

(4) Modified Example 4

Figure 9:
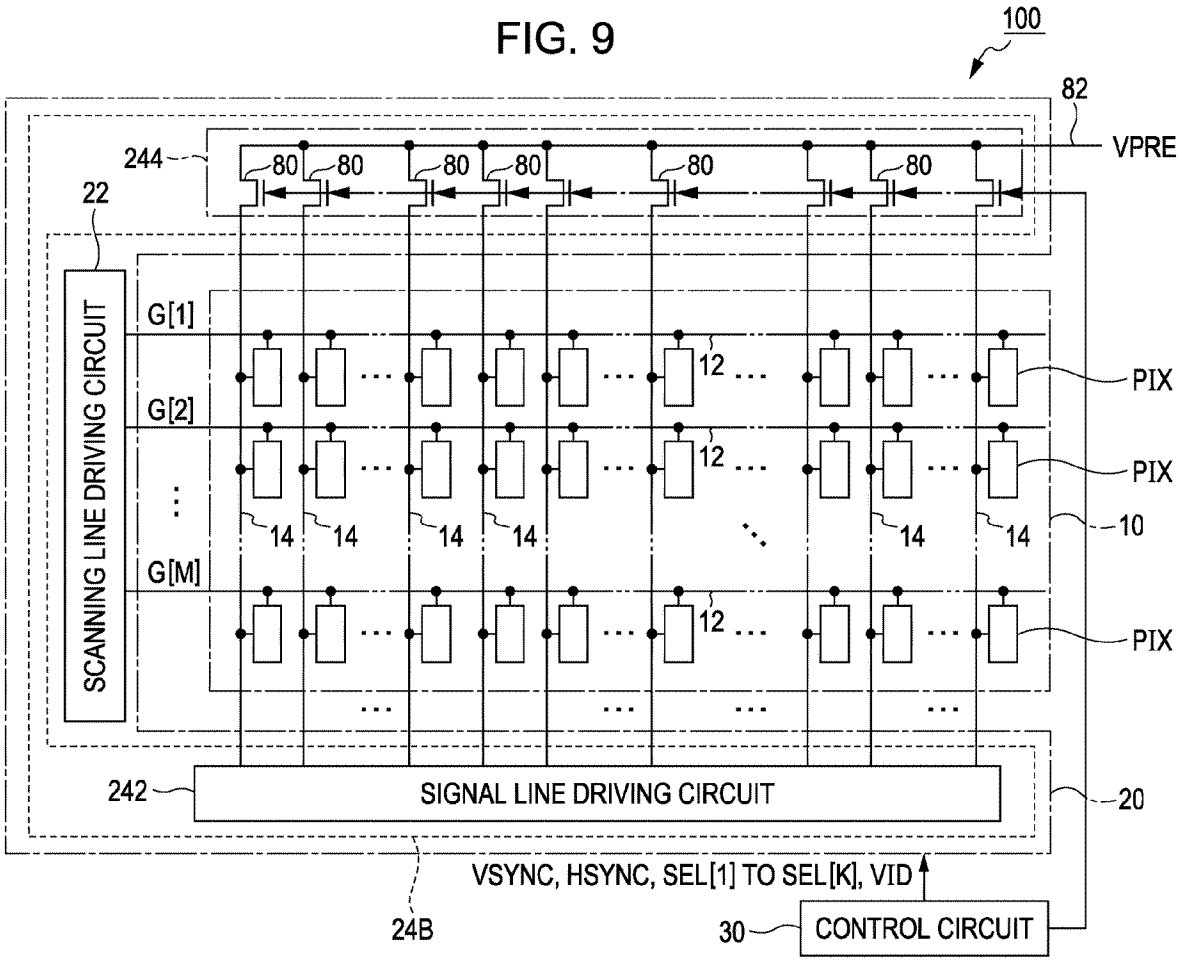
FIG. 9 is a block diagram of an electrooptical device according to a modified example of the present invention.

In each embodiment described above, the gradation potential VG and the pre-charge potential VPRE are supplied to each signal line 14 through a common path; however, as shown in FIG. 9, a configuration in which the gradation potential VG and the pre-charge potential VPRE are supplied to each signal line 14 through a separate path is also adopted. The signal supply circuit 24B of FIG. 9 includes a signal line driving circuit 242 and a pre-charge circuit 244. The signal line driving circuit 242 has the same configuration as that of the signal supply circuit 24 (or the signal supply circuit 24A of the fourth embodiment) in each embodiment described above. The pre-charge circuit 244 includes N switches 80 for controlling conduction between a potential line 82 to which the pre-charge potential VPRE is supplied and each signal line 14. Each switch 80 of the pre-charge circuit 244 is controlled to be in an on state by the control circuit 30 in the pre-charge period TPRE within the unit period U1, so that the pre-charge potential VPRE is supplied to each signal line 14.

(5) Modified Example 5

In each embodiment described above, the pre-charge potential VPREa or the pre-charge potential VPREb is selectively supplied to the signal line 14 in accordance with the polarity of the gradation potential VG; however, a configuration in which only one type of pre-charge potential VPRE is supplied to the signal line 14 may be adopted. In addition, the pre-charge potential VPRE is arbitrarily selected. For example, a configuration in which the pre-charge potential VPRE is set to a potential with the positive polarity with respect to the reference potential VREF may be adopted.

(6) Modified Example 6

A configuration in which N signal lines 14 are classified into J wiring groups B[1] to B[J] may be omitted. That is, the present invention is also applied to a configuration focusing only on one wiring group B[j] in each embodiment described above.

(7) Modified Example 7

A configuration in which an order of shifting the switches 58[1] to 58[K] in the write period TWRT of each of the unit periods U (U1 and U2) to be in an on state is sequentially changed may be also adopted. For example, a configuration disclosed in JP-A-2004-45967 may be preferably adopted.

(8) Modified Example 8

The liquid crystal element 42 is merely an example of the electrooptical element. With respect to the electrooptical element applied to the present invention, a distinction between a self-lighting type of emitting light by itself and a non-lighting type (for example, liquid crystal element) of varying the transmittance or reflectance of external light, or a distinction between a current-driving type driven by the supply of current and a voltage-driving type driven by applying an electric field (voltage) is unquestioned. For example, the present invention is applied to the electrooptical device 100 using a variety of electrooptical elements such as an organic EL element, an inorganic EL element, LED (Light Emitting Diode), an electric field electron emission element (FE (Field-Emission) element), a surface conduction electron emitting element (SE(Surface conduction Electron emitter) element), a ballistic electron emission element (BS (Ballistic electron Emitting) element), an electrophoretic element, an electrochromic element, and the like. That is, the electrooptical element includes a driven element (typically, a display element in which a gradation is controlled in accordance with a gradation signal) using an electrooptical substance (for example, a liquid crystal) in which a gradation (optical properties such as transmittance, brightness, and the like) is changed in accordance with electrical actions such as the supply of the current and the applied voltage (electric field).

F: Application Example

Figure 10:
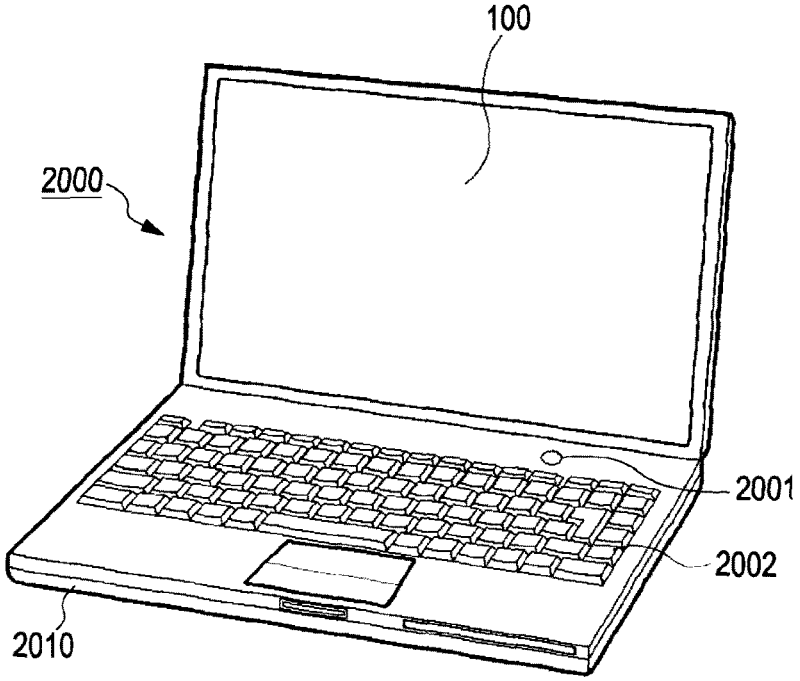
FIG. 10 is a perspective diagram showing an embodiment (personal computer) of an electronic apparatus.
Figure 11:
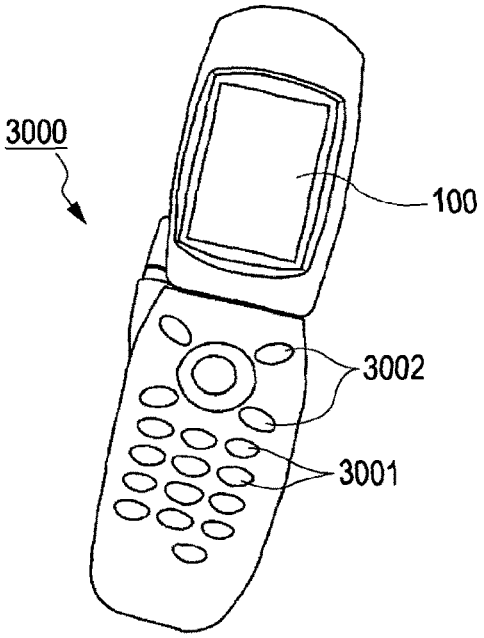
FIG. 11 is a perspective diagram showing an embodiment (mobile phone) of an electronic apparatus.
Figure 12:
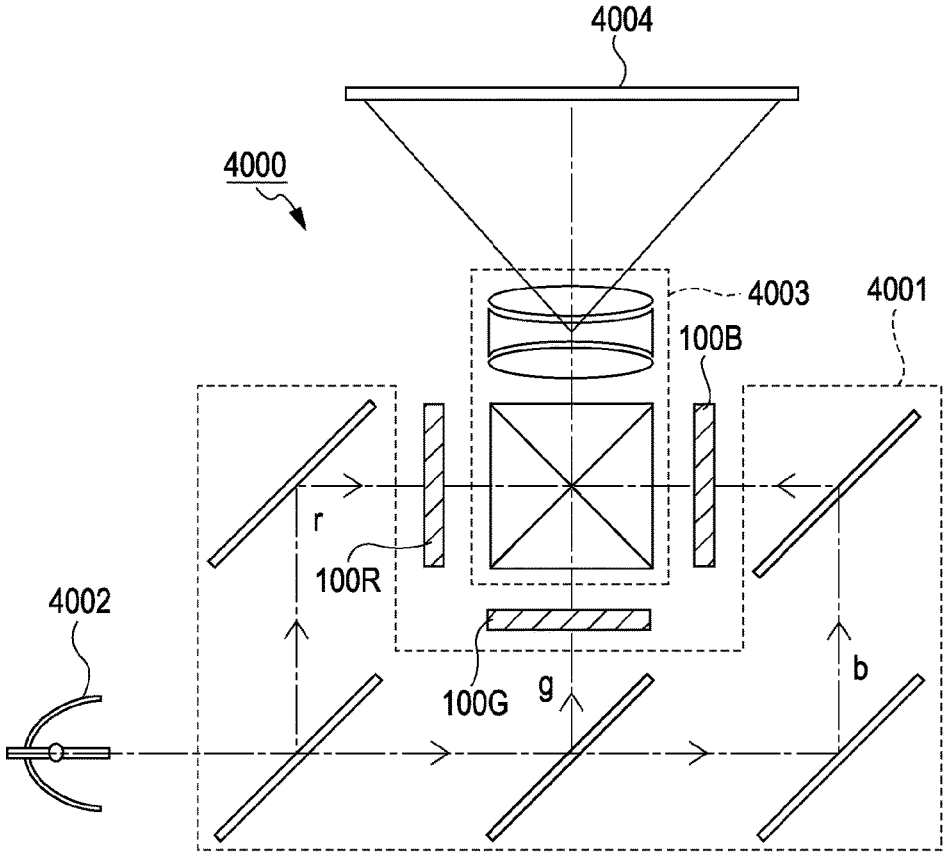
FIG. 12 is a perspective diagram showing an embodiment (projection-type display apparatus) of an electronic apparatus.

The electrooptical device 100 exemplified in each embodiment described above may be used in a variety of electric apparatuses. In FIGS. 10 to 12, a specific embodiment of the electric apparatus adopting the electrooptical device 100 is exemplified.

FIG. 10 is a perspective diagram of a portable personal computer adopting the electrooptical device 100. The personal computer 2000 includes the electrooptical device 100 for displaying a variety of images, and a main body 2010 in which a power switch 2001 and a keyboard 2002 are installed.

FIG. 11 is a perspective diagram of a mobile phone adopting the electrooptical device 100. The mobile phone 3000 includes a plurality of operation buttons 3001, a scroll button 3002, and the electrooptical device 100 for displaying a variety of images. By operating the scroll button 3002, an image displayed in the electrooptical device 100 is scrolled.

FIG. 12 is a schematic diagram of a projection-type display apparatus 4000 (three-plate type projector) adopting the electrooptical device 100. The projection-type display apparatus 4000 includes three electrooptical devices 100 (100R, 100G, and 100B) corresponding to different display colors (red, green, and blue). An illumination optical system 4001 supplies a red element r of light emitted from an illumination device 4002 (light source) to the electrooptical device 100R, a green element g to the electrooptical device 100G, and a blue element b to the electrooptical device 100B. Each of the electrooptical devices 100 functions as an optical modulator (light valve) for modulating each color light supplied from the illumination optical system 4001 in accordance with a display image. A projection optical system 4003 combines the light emitted from each of the electrooptical devices 100, and projects the combined light to a projection surface 4004.

Further, as examples of the electric apparatus to which the electrooptical device relating to the present invention is applied, other than the apparatuses shown in FIGS. 10 to 12, portable information terminals (PDA: Personal Digital Assistants), digital still cameras, televisions, video cameras, video cameras, car navigation systems, automotive indicators (instrument panel), electronic organizers, electronic paper, calculators, word processors, workstations, videophones, POS terminals, printers, scanners, copiers, video players, equipment with a touch panel, and the like may be given.

The entire disclosure of Japanese Patent Application No. 2010-197924, filed Sep. 3, 2010 is expressly incorporated by reference herein.

What is claimed is:

1. An electro-optical device, comprising:

a plurality of pixels that are arranged so as to correspond to a plurality of intersections of a plurality of scanning lines and a plurality of signal lines;

a scanning line driving circuit that selects one of the plurality of scanning lines in each of a plurality of horizontal scanning periods; and a signal supply circuit that supplies a designated gradation potential to each of the plurality of pixels in a first write period of each of the plurality of horizontal scanning periods;

a plurality of switches that are each disposed between the signal supply circuit and the plurality of signal lines to electrically connect the signal supply circuit and a corresponding signal line in each of the plurality of horizontal scanning periods; and a control circuit that controls each of the plurality of switches, wherein the signal supply circuit supplies a predetermined pre-charge potential simultaneously to the plurality of signal lines in a first horizontal scanning period during a precharge period prior to the write period, and does not supply the predetermined pre-charge potential to the plurality of signal lines in a second horizontal scanning period, wherein the second horizontal scanning period is different from the first horizontal scanning period, wherein the control circuit controls each of the plurality of switches so as to simultaneously electrically connect the signal supply circuit and the plurality of signal lines in the pre-charge period of the first horizontal scanning, and electrically connects the signal supply circuit and the plurality of signal lines in a sequential manner during each of the write periods of the first horizontal period and the second horizontal scanning period to supply the designated gradation potential, and does not electrically connect the signal supply circuit and the plurality of signal lines to supply the predetermined pre-charge potential to the signal lines prior to the write period of the second horizontal scanning period.

2. The electro-optical device according to claim 1, wherein the first horizontal scanning period and the second horizontal scanning period are set to the same time length, and the write period of the first horizontal scanning period and the write period of the second horizontal scanning period are set to the same time length.

3. The electro-optical device according to claim 1, wherein the first horizontal scanning period and the second horizontal scanning period are set to the same time length, and a time length of the write period of the second horizontal scanning period is longer than a time length of the write period of the first horizontal scanning period.

4. The electro-optical device according to claim 1, wherein the write period of the first horizontal scanning period and the write period of the second horizontal scanning period are set to the same time length, and a time length of the second horizontal scanning period is shorter than a time length of the first horizontal scanning period.

5. The electro-optical device according to claim 1, wherein the scanning line driving circuit sequentially selects a plurality of scanning lines in each of the plurality of horizontal scanning periods in a plurality of vertical scanning periods.

6. The electro-optical device according to claim 1, wherein each of the plurality of horizontal scanning periods corresponding to the odd number lines is set to one of the first horizontal scanning period and the second horizontal scanning period.

7. The electro-optical device according to claim 6, wherein each of the plurality of horizontal scanning periods corresponding to the even number lines is set to the other of the first horizontal scanning period and the second horizontal scanning period.

8. The electro-optical device according to claim 1, wherein a control circuit that controls all of the plurality of switches in an on state in the pre-chare period of the plurality of first horizontal scanning periods, and sequentially controls each of the plurality of switches in an on state in the write period of each of the plurality of horizontal scanning periods.

9. An electronic apparatus including the electro-optical device of claim 1.

10. A control method for an electro-optic device provided with a plurality of scanning lines, a plurality of signal lines and a plurality of pixels each provided so as to correspond to one of intersections of the plurality of scanning lines and the plurality of signal lines, a signal supply circuit supplying a designated gradation potential to each of the plurality of pixels in a first write period of each of the plurality of horizontal scanning periods, a plurality of switches which are each disposed between the signal supply circuit and the plurality of signal lines to electrically connect the signal supply circuit and a corresponding signal line in each of the plurality of horizontal scanning period and a control circuit controlling each of the plurality of switches, the control method comprising;

controlling the plurality of switches via the control circuit so as to simultaneously electrically connect the signal supply circuit and the plurality of signal lines in a pre-charge period of the first horizontal scanning period which is prior to the write period;

supplying a predetermined pre-charge potential simultaneously to the plurality of signal lines in a first horizontal scanning period during the pre-charge period and not supplying the predetermined pre-charge potential to the plurality of signal lines in a second horizontal scanning period, wherein the second horizontal scanning period is different from the first horizontal scanning period;

electrically connecting the signal supply circuit and the plurality of signal lines via the plurality of switches in a sequential manner during each of the write periods of the first horizontal period and the second horizontal scanning period; and supplying the designated gradation potential to the corresponding signal line during each of the write period of the first horizontal period and the second horizontal scanning period;

wherein the control circuit does not electrically connect the signal supply circuit and the plurality of signal lines to supply the predetermined pre-charge potential to the signal lines prior to the write period of the second horizontal scanning period.

11. The control method for the electro-optical device according to claim 10, wherein the first horizontal scanning period and the second horizontal scanning period are set to the same time length, and the write period of the first horizontal scanning period and the write period of the second horizontal scanning period are set to the same time length.

12. The control method for the electro-optical device according to claim 10, wherein the first horizontal scanning period and the second horizontal scanning period are set to the same time length, and a time length of the write period of the second horizontal scanning period is longer than a time length of the write period of the first horizontal scanning period.

13. The control method for the electro-optical device according to claim 10, wherein the write period of the first horizontal scanning period and the write period of the second horizontal scanning period are set to the same time length, and a time length of the second horizontal scanning period is shorter than a time length of the first horizontal scanning period.

14. The control method for the electro-optical device according to claim 10, comprising:

selecting a plurality of scanning lines in each of the plurality of horizontal scanning periods in a plurality of vertical scanning periods.

15. The control method for the electro-optical device according to claim 10, wherein each of the plurality of horizontal scanning periods corresponding to the odd number lines is set to one of the first horizontal scanning period and the second horizontal scanning period, and each of the plurality of horizontal scanning periods corresponding to the even number lines is set to the other of the first horizontal scanning period and the second horizontal scanning period.

* * * * *